United States Patent [19]

Boot et al.

[11] 3,973,365

[45] Aug. 10, 1976

[54] CEMENTITIOUS BUILDING CELL

[75] Inventors: Phillip Handford Boot, Mosman; Peter Edgington Ellen, Turramurra, both of Australia

[73] Assignee: Handford Boot Patents Pty. Ltd., Pymble, Australia

[22] Filed: Feb. 27, 1975

[21] Appl. No.: 553,728

Related U.S. Application Data

[63] Continuation of Ser. No. 358,802, May 9, 1973, abandoned.

[30] Foreign Application Priority Data

May 10, 1972 Australia ..... 8905/72

[52] U.S. Cl. ..... 52/79; 52/80; 52/236; 52/262

[51] Int. Cl.[2] ..... E04H 1/02; E04B 1/32

[58] Field of Search ..... 52/79, 80, 82, 91, 86, 52/85, 236, 262, 743, 745, 758 B

[56] References Cited

UNITED STATES PATENTS

| | | | |
|---|---|---|---|
| 1,185,871 | 6/1916 | Broughton | 52/262 X |
| 2,267,912 | 12/1941 | Hain | 52/80 X |
| 2,892,239 | 6/1959 | Neff | 249/13 X |
| 3,228,161 | 1/1966 | Mc Cown | 52/758 B |
| 3,286,415 | 11/1966 | Schlenker | 52/86 |
| 3,365,846 | 1/1968 | Sperling | 52/86 |
| 3,455,074 | 7/1969 | Rice | 52/262 X |
| 3,706,168 | 12/1972 | Pilish | 52/262 X |
| 3,714,304 | 1/1973 | Carner et al. | 52/745 X |
| 3,772,835 | 11/1973 | Cox et al. | 52/91 X |

FOREIGN PATENTS OR APPLICATIONS

| | | | |
|---|---|---|---|
| 39,666 | 2/1932 | France | 52/86 |
| 644,890 | 10/1950 | United Kingdom | 52/79 |
| 741,791 | 12/1955 | United Kingdom | 52/199 |
| 1,027,807 | 4/1966 | United Kingdom | 52/82 |
| 649,729 | 1/1951 | United Kingdom | 52/82 |

*Primary Examiner*—Price C. Faw, Jr.
*Assistant Examiner*—Leslie Braun
*Attorney, Agent, or Firm*—Murray and Whisenhunt

[57] ABSTRACT

A concrete cell, for the construction of buildings, made from two components, one consisting of the walls and roof and the other consisting of a floor which may be of any suitable material the principal characteristic of the cell being that the roof and wall component is made of very thin concrete between ¼ inch and 2 inches, and that the roof of the cell is formed as a thin shell dome or cylindrical shell sprung from the tops of the walls to provide rigidity to the thin structure. The concrete is preferably reinforced, for example, with steel. Cells may be assembled together to form single or multi-story buildings in which the cell will generally be a non load bearing structural entity constituting a capsule to protect its contents and being arranged in an encompassing structure.

15 Claims, 17 Drawing Figures

Figure 1:
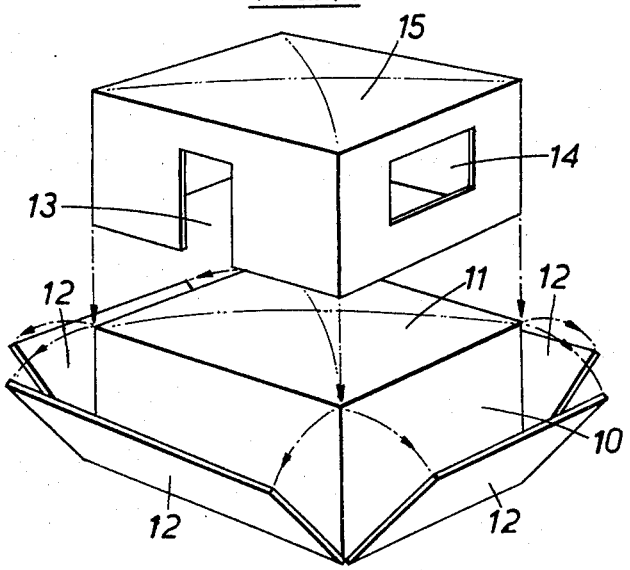

FIG. 7.
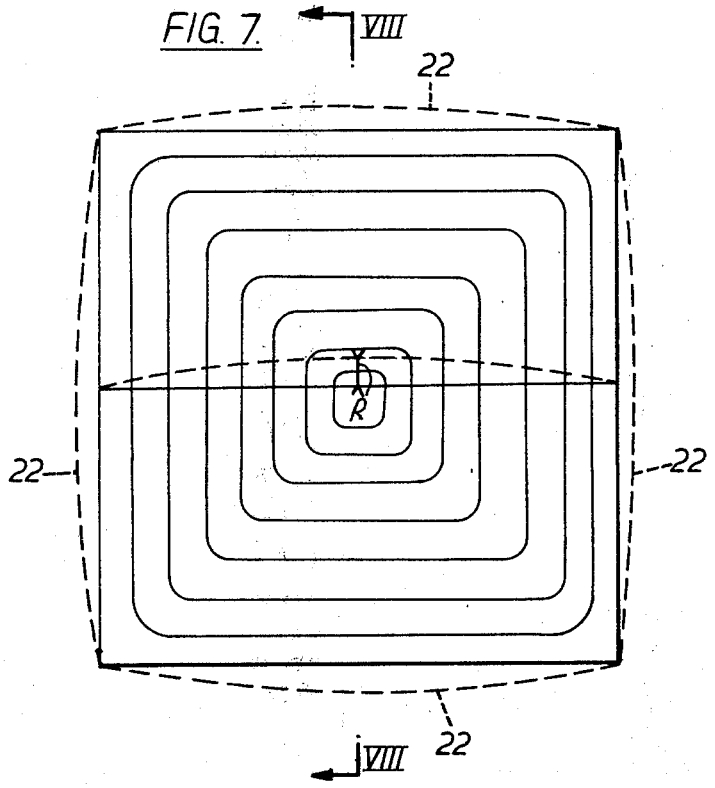
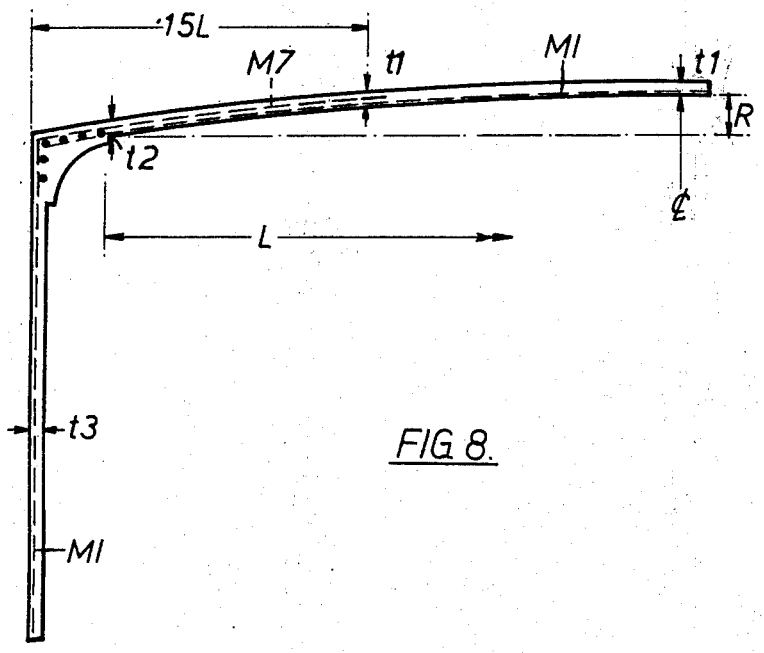
FIG 8.

CEMENTITIOUS BUILDING CELL

This is a continuation of application Ser. No. 358,802 filed May 9, 1973.

The present invention relates to improvements in or relating to building construction and more particularly to the provision of building cells, boxes or modules (for convenience the word cell will be used in this specification to designate all such structures) from which both single and multi storey buildings may be constructed.

At the present time the majority of dwellings are constructed by conventional methods and while quite satisfactory results are produced, the ever increasing cost of buildings by reason, for example, of the costs attributable to labor, has led to a situation in which new methods of building are continually being sought. In the production of timber dwellings, for example, it is now common practice in certain countries to manufacture individual rooms or groups of rooms completely in a factory and assemble them on the site with a useful increase in economy and efficiency.

The object of the present invention is to enable such methods to be better used in the construction of buildings made from concrete. Whilst such material is durable and universally acceptable as a high quality material of reasonable cost, no wholly satisfactory method of factory manufacture using it is available.

The present invention is centered around the concept of making individual rooms or groups of rooms as cells that can be completed wholly or substantially in a factory, or a factory like environment, thus assisting in achieving better workmanship, mechanisation, quality and quantity control of materials, better purchasing power and better productivity from labour at lower costs. Particular advantages in this respect can be obtained in connection with service areas which are the most expensive part of a building to produce per unit area. In such a method a room is produced preferably as a substantially weather sealed cell in the factory and is then transported to the site on which the building is to be erected. The desirability of this approach has been previously recognised and buildings have been erected from a number of complete cells made of reinforced concrete.

The use of reinforced concrete in a conventional way, however, has resulted in the production of relatively heavy cells, of for example 20 to 35 tons, which require very elaborate transport and lifting means to convey them from the factory to the site of erection and to erect them.

The principal object of the present invention is to produce a building cell which fulfills the requirements set out above and has the advantage of being constructed from concrete material with or without reinforcement but which can be made sufficiently light in weight as to minimise problems of transportation and erection.

It is considered that the main utility of the invention will lie in the construction of cells which are not in themselves load bearing structural members but each of which constitutes a capsule which serves to contain and protect the internal finish of a room or rooms, capsules in a building being arranged within a separate encompassing structure.

The invention consists in a structurally stable building cell for the construction of buildings, the cell being constructed to form the whole or part of a room or rooms of a building and comprising four internally substantially flat vertical walls, a roof and a floor, the walls and the roof being constructed as a unitary integral structure from concrete, and the floor being attached thereto, the thickness of the walls and the roof of the cell lying within the range of from ¼ inch to 2 inches except in areas of localised thickening, the roof being in the form of a structure having the structural action of or approximating to the structural action of a double curved thin shell dome or cylindrical shell sprung from the tops of the walls. The term dome includes very shallow domes, generalised polyhedral domes composed of two or more rigidly interconnected thin plates, anisotropic domes, and domes having penetrations. The term cylindrical shells includes very shallow cylindrical shells prismatic shells composed of two or more rigidly interconnected thin plates, anisotropic cylindrical shells and cylindrical shells having penetrations.

The term thickness of the walls and the roof is the thickness measured transversely in areas free from ribs and other localised thickening.

A minor or major portion of one or more of the walls may be omitted to provide for door and window apertures or for the juxtaposition of two cells to form a large room. It is preferred that the thickness of the walls and roof of a cell is between ⅜ inch and 1½ inches, exclusing minor areas of localised thickening. In this connection the structure may be thickened locally by the addition of ribs excluding the roof or walls and if there is a discontinuity in the curvature of the roof at the transition from the roof to the walls or if there is a very rapid change of curvature in this location the edge of the roof may be strengthened by a ring or system of beams or ribs or thickening. Thickening may also occur at the junction of adjacent walls. The term roof is not to be taken to signify that in use it is exposed to the elements and is used to refer to the top of a cell, the undersurface of the roof constituting a ceiling. It is preferred that the concrete used be reinforced with steel or other suitable reinforcing material.

Figure 1A:
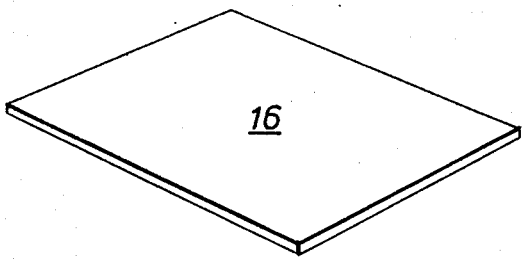
Figure 2:
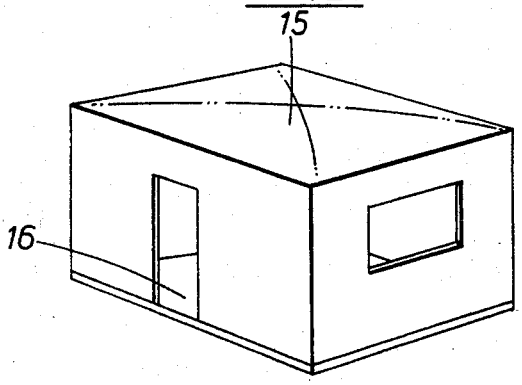
Figure 3:
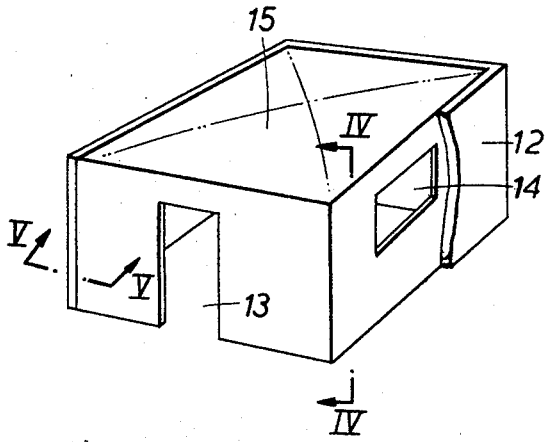
Figure 4:
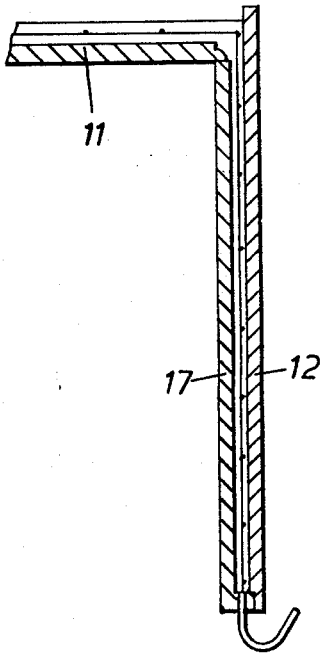
Figure 5:
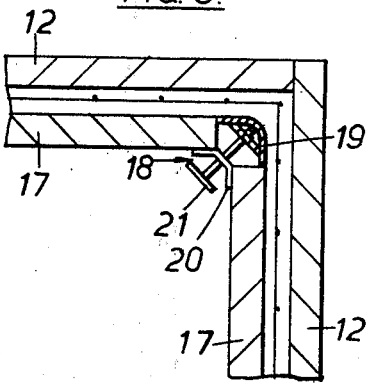
Figure 6:
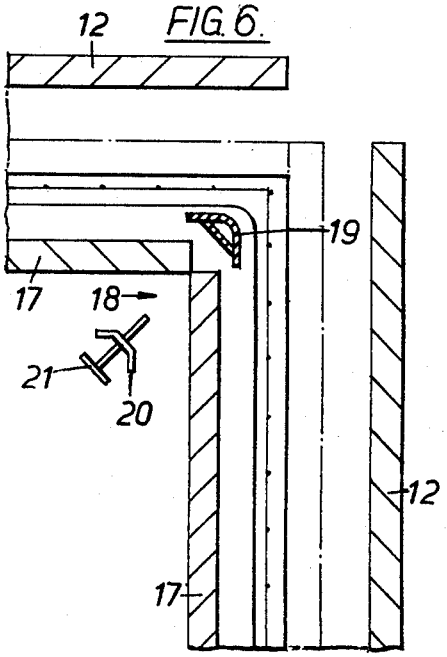
Figure 9:
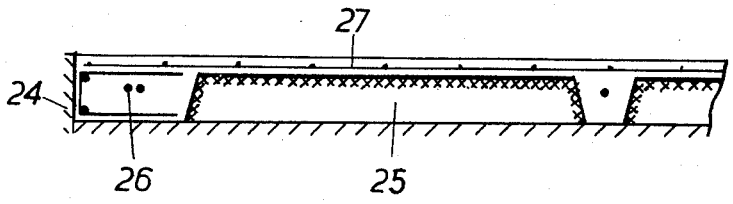
Figure 10:
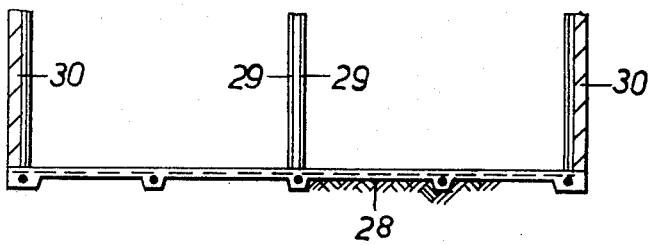
Figure 11:
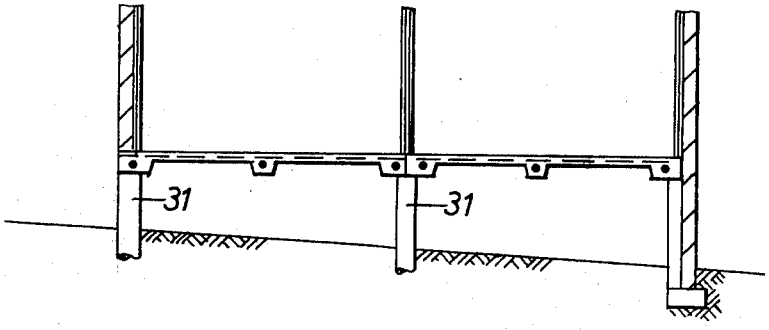
Figure 12:
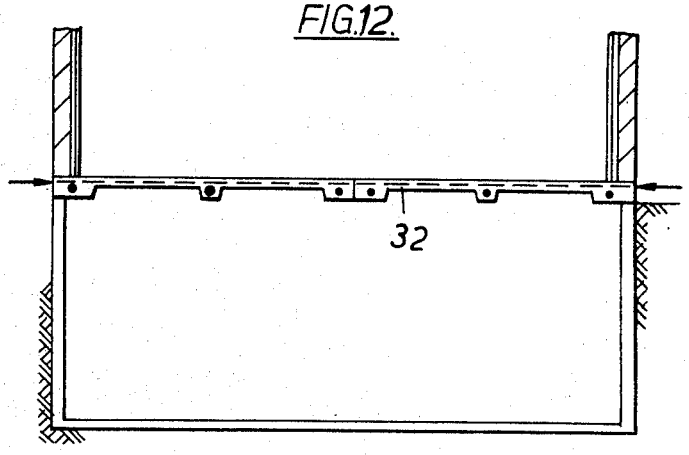
Figure 13A:
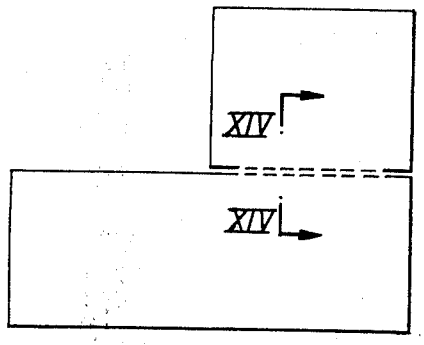
Figure 13B:
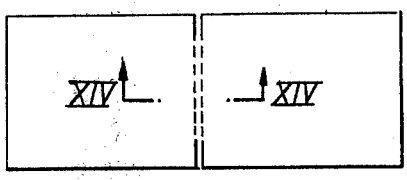
Figure 14:
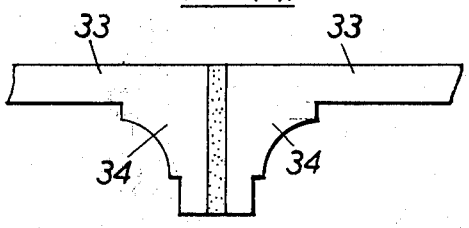
Figure 15:
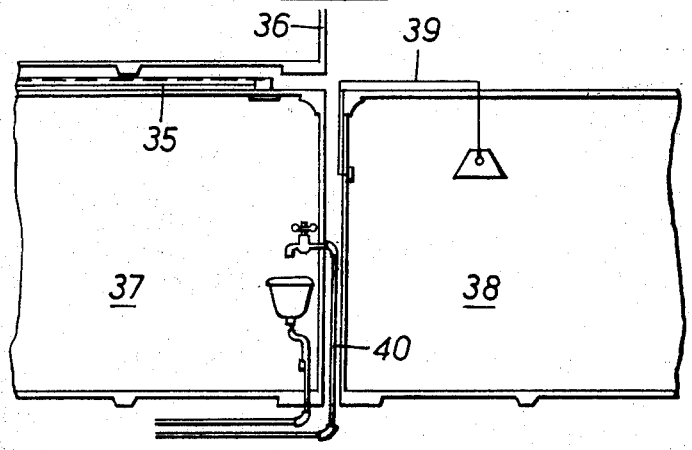

In order that the nature of the invention may be better understood details of a building cell constructed according to the invention and methods of constructing it are described, by way of example, with reference to the accompanying diagrammatic drawings in which:

FIG. 1 is a perspective view of the cast wall and roof component of a cell and the parts of an opened and retracted mould from which it has been removed, FIG. 1*a* shows a cast floor component for attachment to the wall and roof component, FIG. 2 shows the completed floor joined to the wall and roof component, FIG. 3 is a perspective view of a cast wall and roof component with some of the external mould panels in position, the internal mould being omitted for the sake of clarity, FIG. 4 is a part cross-section on plane IV—IV of FIG. 3, FIG. 5 is a part cross-section on plane V—V of FIG. 3, FIG. 6 is a view similar to FIG. 5 but showing parts of the inner and outer mould retracted, FIG. 7 is a plan view of a cell, FIG. 8 is a cross-sectional elevation of a portion of the cell of FIG. 7 on the line VIII—VIII illustrating details of a typical arrangement of reinforcement, FIG. 9 is a cross-section of a portion of a floor component of a cell, FIG. 10 illustrates the use of the floors of cells cast in-situ, FIG. 11 illustrates the manner in which the floors of adjacent cells are supported on piers, FIG. 12 illustrates an arrangement in which the floors of adjacent cells are supported by post-tensioning cables, FIG. 13*a* and 13*b* are plans illustrating the manner in which a substantial portion of a wall may be omitted in adjacent cells to form a large room, FIG. 14 is a cross-sectional view of portion of the roofs of adjacent cells on the line XIV—XIV of FIGS. 13*a* and 13*b* and FIG. 15 illustrates the manner in which air conditioning ducts, plumbing and electrical services, and any other services required may be accommodated in the spaces between cells in a building.

The application of the invention enables a building to be constructed particularly economically from a number of individual cells placed side by side in such a relationship that a complete building with the necessary rooms and intercommunication between them is formed. The invention may be applied to the construction of cells for building single storey buildings or multi-storey buildings, the latter being formed by placing cells one on top of the other with adequate structural support as required. Thus the organisation of the manufacture of individual cells is orientated towards accomplishing these objectives. A single cell is normally a complete unit consisting of a component which forms the floor and a component which forms the walls and roof, the latter component being preferably formed in one piece. Each cell is not necessarily complete in its entirety as parts or whole sections of walls may be omitted to provide for door or window openings or to enable two cells to be arranged side by side to form a larger room. This will be described in more detail below.

Cells are preferably constructed by methods described below, from concrete made up of an aggregate or aggregates bound by a matrix composed of ordinary portland cement, high alumina cements, synthetic resins and/or any combination of cementitious materials and suitable additives which can be structurally integrated. The aggregate may be natural or synthetic. An example of a suitable material is concrete made from portland cement, sand and water together with conventional additives.

As stated above, each cell is made up of two components, one component consisting of the walls and roof which may be moulded as an integral unit. The other component is the floor which is preferably cast as a flat surfaced concrete slab and subsequently joined to the walls as described below. Other types of floor, for example, wooden or metal flooring may be used but these are not preferred.

In order to facilitate the transport and erection of cells they should be made as light as possible consistent with stability. Calculations indicate that it should be possible to make cells according to the invention of the order of 25% in large sizes and 33% in small sizes of the weight of a similar cell designed on lines at present in use. It is in achieving this objective that the difficulty lies and in which the principal features of the present invention is to be found. The invention makes use of cell walls of a thickness of between ¼ inch and 2 inches, and preferably between ⅜ inch and 1½ inches excluding ribs or local thickening, preferably reinforced with suitable reinforcing material such as steel. A similar thickness is adopted for the roof of the cell. However, if such a thin structure were to be designed on conventional lines utilising a slab roof, it would be relatively weak and unstable. The present invention, however, overcomes this difficulty by the use in association with the thin walls of a domed roof structure having the characteristics defined above. The roof is made of thin concrete preferably either of substantially uniform thickness or of a thickness that diminishes towards the center and with a relatively low rise to chord ratio of from 1:10 to 1:60 and is preferably cast monolithically with the walls. It may, however, be cast separately and joined to the walls, for example, by structural grouting. A reinforced section along the edges of the roof which contains a ring or system of beams or ribs or thickening or strengthening to stiffen the edges of the roof may be provided. It may be in the form of a cornice cast integrally with the structure. The beam may if desired project upwardly above the junction of the roof and walls.

In connection with the range of rise to chord ratios given above it should be appreciated that while it would be technically possible to produce a roof having the necessary stiffening effect with a rise to chord ratio greater than 1:10, such a curvature might be unattractive and possibly unacceptable. At the other end of the scale, with a rise to chord ratio approaching 1:60, it is considered that it may be necessary to further strengthen the edges of the roof.

Both walls and roof may be provided with integrally cast external ribs to enable a lesser thickness of concrete to be used over the main areas, if by this means an overall reduction in the amount of material used can be obtained in a particular structure. Tests have shown that the presence of external ribs in cell walls can give a marked increase in strength without increasing the materials used.

FIGS. 1 and 2 illustrate the basic procedure in the construction of a cell according to the invention. In FIG. 1 is shown a double mould consisting of an internal rectangular mould 10 with an upwardly convex top 11 surrounded by four moveable external mould panels 12. Apertures for a door and window are indicated at 13 and 14 in the cast wall and roof element 15 which has been lifted from the mould by means of a crane or suitable lifting gear (not shown). FIG. 1a shows a cast concrete floor slab 16 the construction of which is described in more detail below. FIG. 2 shows the two components of the cell namely the integral wall and roof component 15 and the floor slab 16 joined, the cell being ready for internal finishing.

Some details of the type of mould to be used in the preferred method of moulding of cell units according to the invention are shown in FIGS. 3 to 6. This method involves the use of retractable internal wall mould panels 17 and four removable external wall mould panels 12. It is necessary for the internal mould panels to be retractable to enable the monolithically cast wall and roof component of the cell to be removed from it. This is achieved by the corner details shown in FIGS. 5 and 6 which show two interal wall panel moulds 17 joined by a corner joint 18 which during the moulding process is set up as shown in FIG. 5, the external wall mould panels 12 spaced apart from the internal panels 17 in accordance with the thickness of the walls to be produced. It will be seen that this corner joint 18 provides an accurate right angle joint at the junction of the adjacent mould walls. The corner joint 18 consists of an outer corner member 19 and an inner corner member 20 which are connected by a number of hand screws 21. When the joint is assembled as in FIG. 5 the parts of the mould are held in their correct relative positions for carrying out the moulding operation. After the wall and roof component has set the screws 21 and inner corner member 20 are moved, allowing the inner mould panels 17 to be retracted as shown in FIG. 6. This permits the wall and roof component to be lifted clear of the mould after the external mould panels 12 have been removed.

The moulding process is illustrated in FIG. 4 in which concrete grout is shown as being pumped into the space between the internal and external mould panels 12 and 17, from a point at or near the bottom of the mould walls. The concrete is pumped in as grout in a relatively liquid form and rises in the space between the mould panels, driving out air and thus substantially avoiding the production of voids in the concrete. Reinforcing steel, which may be in the form of a layer or layers of welded mesh fabric is placed around the internal wall mould panels 17 before the assembly of the external wall mould panels; the concrete rises through this embedding it as it rises. Any window frames, door frames, or alternate fixing brackets or sub-frames, etc., to be included in the cell structure, are also placed between the mould walls when the reinforcing steel is being placed in position and the concrete will thus flow around these. Alternatively, blockouts may be used to define the desired apertures. In addition to the reinforcing steel and door and window frames, a variety of other minor parts are advantageously set in position in the moulds before introducing the concrete, such things, for example as lifting clips, brackets, lugs and steel plates. Steel plates are built into the bottom of the walls to enable the wall and roof component to be secured to the floor slab by welding to a similar corresponding steel plate set in the floor slab.

When the concrete has risen to its full height between the internal and external wall mould panels 17 and 12, the concrete is then applied over the top of the internal mould in a layer to form the upwardly convex rectangular domed roof. During the moulding process the mould is subjected to vibration with a view to eliminating voids and compacting the grout. The roof in this case is reinforced, preferably with steel mesh in a manner similar to the walls.

In the general application of the invention some reinforcing steel or other suitable reinforcing material may be required for both walls and roof in view of the thin shell structure. Where steel reinforcement is used it is considered that reinforcing percentages up to a maximum of 10% of the cross-sectional area of the concrete will be employed depending on the size and configuration of the cell.

The plan view of a cell shown in FIG. 7 is intended to illustrate by contour lines the fact that the roof is a domed shell sprung from the walls. The broken line 22 illustrates the shape that the cell will tend to assume, a tendency resisted by the stiffening around the periphery of the roof.

FIG. 8 shows the manner in which stiffening may be in the form of a reinforced concrete cornice, the cornice being visible from the interior of the cell and forming an architectural feature of it. This drawing also illustrates the domed nature of the roof.

FIG. 8 also illustrates a typical arrangement of reinforcement in the wall and roof component. In areas indicated at M1 a single layer of steel welded mesh fabric is used and in the area M7 two layers of similar material. In the table set out below are some typical dimensions which a cell may assume together with particulars of wall and roof thickness and reinforcement for each case. In the table $t_1$, $t_2$ and $t_3$ are the thicknesses at the points so indicated in FIG. 8, the thickness being substantially constant between the two marked $t_1$ and increases uniformly from the left hand point marked $t_1$ to that marked $t_2$ which represents localised thickening.

FIG. 8 also serves to illustrate what is meant by the rise and chord of the shell of the roof in the most usual case where the edge of the shell is well defined. L applies to the smaller of the overall cell dimensions and the rise of the shell is indicated at R. Where the roof and wall form a continuous surface the chord and rise are measured over the middle 70% of the overall width of the cell. The distance between the left hand point indicated at $t_1$ and the edge of the wall is .15L.

TABLE

| Room Dmns o/all | $t_1$ | $t_2$ | $t_3$ | R | Conc. or grout stgth F'c | Mesh M1 | Mesh M7 (two layers) | Reinf. in Edge Stiffening. |
|---|---|---|---|---|---|---|---|---|
| 8'× 8 ' | ⅜" | 1" | 1" | 4" | 4,000 lbs./sq. inch. | .03 sq. in.per ft. | .03 sq. in.per ft. | .5 sq. in. |
| 10'×12' | ½" | 1¼" | 1" | 5" | " | .03" | .06" | .8" |
| 10'×15' | ¾" | 1½" | 1¼" | 6" | " | .03" | .08" | 1.0" |
| 15'×15' | ¾" | 2" | 1½" | 8" | " | .03" | .12" | 1.2" |
| 15'×24' | 1½" | 2½" | 2" | 10" | " | .06" | .14" | 1.5" |
| 18'× 18' | 1½" | 2½" | 2" | 12" | " | .06" | .14" | 1.8" |

The references to areas are to cross sectional areas of the reinforcing material.

Another method of forming the wall roof component of the cell is by means of a single skin mould. In this case, the concrete is applied by hand to the exterior of the inner mould by spraying or trowelling after the reinforcing steel if required has been placed in position. This method of manufacture is considered less satisfactory than that described above, in that the amount of labour involved is greater and the chance of leaving voids in the concrete is also greater. However, the capital cost of the mould is considerably less.

Alternatively the roof and each wall or a combination of these may be manufactured separately and then joined to form a unitary integral structure. Where this procedure is followed the parts of a cell may be assembled at a location other than the factory in which they are manufactured.

A floor for the cell is made in a conventional manner one example of a floor being illustrated in FIG. 9. This is made by casting concrete into formwork consisting of edge forms 24 and panforms 25 arranged in a waffle pattern, pretensioned cables 26 and a reinforcing mesh 27 being set in position before pouring. When the floor has set and cured it is secured to the walls of the cell by welding the steel plates of the two components together as described above.

After connection of the floor to the upper component of the cell the joint between the floor and the walls is grouted or sealed as necessary, defects in the cell if any repaired and it is generally prepared for finishing. Plumbing, pipes, taps, wastes etc. are installed and all necessary preliminary electrical work carried out. Kitchen cupboards, sinks, bench tops, etc., are installed, tiled and in fact, all internal fittings and furnishings that would normally be installed by a builder in a conventionally built building may be built into the cells in the factory and the interior of each cell can be completely painted, finished and sealed against the entry of weather.

The physical characteristics of an experimental cell constructed according to the present invention and having an external appearance substantially as shown in FIG. 2, and an internal cornice as shown in FIG. 8 are as follows:

| Inside dimensions |
|---|
| width 9.08′ |
| Length 12.5′ |
| Height 8′to the underside of the cornice |
| Height from the ground at centre of the roof - 8.54′ |
| Wall thickness in unthickened areas - 1″, |
| Weight of roof and wall unit - 2.9 tons, |
| Weight of floor - 1.9 tons, |
| Total weight - 4.8 tons |

Reinforcement

Reinforcing steel was provided throughout the wall roof component on the basis of a content of 1.3% of the cross-sectional area of the concrete corresponding to a minimum of 2 layers of 2 inches × 2 inches × 10 S.W.G. galvanised steel wire fabric. Additional fabric was placed in critical areas, for example, the thickened and strengthened areas, constituted by the cornice and areas adjacent thereto.

In the cornice 5 × ½ inch diameter reinforcing bars of steel, were included.

Floor Panel

This is constructed as a conventional reinforced waffle slab concrete floor.

Roof

This has on the shortest span, a rise of 2.5 inches measured between the cornices, giving a rise to chord ratio of about 40:1.

Seven days after casting the wall-roof component of the cell which was free standing and unsupported, was loaded on the top of the roof with an evenly distributed load totalling 1.5 tons (i.e. about 30 lbs. sq.ft.) which produced a downward deflection of the roof of 0.14 inch at the center of the dome. After 2 hours the load was removed and the roof recovered fully.

An identical cell was constructed having superimposed on the roof 3 ribs, one positioned across the center of the shorter span, the others spaced 2.75′ on each side of the center rib. Each rib extended 3 inches above the upper surface of the roof and had a minimum width of 2 inches having sloping sides. The ribs contained 1 inch × 1 inch × 10 S.W.G. galvanised wire mesh steel reinforcement of folded top-hat section with a ⅜ inch diameter steel bar placed at the crown and a ¼ inch diameter bar placed either side of the base. The ribs extended the full extent of the 9.08 feet span.

This was loaded under the same loading conditions and the deflection was reduced to 0.08 inch. The inference to be drawn from this test is that the presence of the ribs adds to the strength of the roof. While the added strength was not significant for a cell of the dimensions tested the result indicates that the use of ribs could be of value in the case of shells of different sizes and configurations.

The concrete mix used in the construction of the cells described above was:

1 part portland cement
1¼ parts sand
Common additives

Water was added to produce a grout having a viscosity suitable for pumping and a compressive strength in excess of 4,000 p.s.i. at 28 days.

To construct a building, cells are transported to the site which has been previously prepared and all preparatory work for drains, etc. is carried out. In the construction of a house the cells can be made with the floors of the cells cast in-situ as illustrated in FIG. 10. In this case, the site is cleared and levelled under the building and a layer of hard core or road base 28 is laid, levelled and compacted and the floor is cast in-situ. The cells are then placed in their correct positions on the floors as is indicated in FIG. 10. The cell walls 29 are spaced apart at a distance of about 1 inch or more to leave the necessary room between the adjacent cells for electrical conduits and plumbing pipes. As may be seen on the left of FIG. 10 the raft floor can be taken out beyond the cell wall so as to provide a footing for the external cladding 30, which is, for example, brick veneer.

In some circumstances the site is not suitable for a raft floor, in which case it is necessary to provide piers 31 as shown in FIG. 11. Here, the individual cells are simply placed so that their floors will rest or are attached to the tops of the piers, the walls of the adjacent cells being arranged as described above.

In FIG. 12 it will be seen that the central support has been omitted and the floors of adjacent cells supported by means of post-tensioning cables 32 passed through the ducts previously placed in the floors, to allow unrestricted larger areas below. To permit, for example, the provision of a garage underneath the house.

Doors and door fixings are located by belting or similarly fixing between adjacent cells.

The assembly of cells constituting a house is surrounded by means of an external cladding which may be for example a brick veneer 30 (see FIG. 10) or thin pre-cast or manufactured sections fixed to or physically hung from the cells with additional vertical or lateral support external to the cells.

As has been mentioned above, the major part of one wall of a cell may be omitted to enable a larger room to be formed and the possibilities of this are illustrated in FIGS. 13a and 13b where two rooms are shown formed in this manner. It should be appreciated that under these circumstances, the roof edges of the two adjacent cells co-operate in providing a rigid structure despite the absence of a substantial portion of one wall of each cell. This is illustrated in FIG. 14 in which it will be seen that adjacent roofs 33 terminate in cornices 34, the portions of the walls of the cells below the cornices being omitted. To give greater strength to the cornice over the opening attachment or filling of the void between the cornices may be necessary.

A multi-storey building made up from cells constructed according to the invention may be constructed by arranging cells side by side and one on top of another. It will be appreciated that by reason of the convexity of the roofs of the cells, packing will be required along the edges of the floors of the cells to take this into account. The whole structure can be made rigid by the use of vertical and horizontal structural members. In addition vertical reinforced concrete columns may be formed at the intersections of cells to provide support for upper cells.

FIG. 15 shows how air conditioning ducts 35 may be accommodated in the cavity between the vertically adjacent cells 36 and 37 and electrical wiring 39 and plumbing pipes 40 between horizontally adjacent cells 37 and 38.

While it is proposed above that each cell should have its own individual floor, two upper cell components may share the same floor component. It will be appreciated that this will be practical only in connection with relatively small rooms side by side as otherwise the weight and size of the combined cells is likely to exceed the maximum desirable weight and size for transportation and erection purposes.

The particulars given above are intended only to assist in an understanding of the invention and are not intended as a comprehensive guide to the construction of a building and many steps of a more or less conventional nature have been omitted for the sake of brevity.

If it were desirable for some reason not to attach the floor to the wall/roof component within the factory, it would be possible to transport the wall/roof component to the site and there attach it to a poured-in-situ or assembled floor, the necessary finishing work then being carried out.

In the case of multi-storey buildings, it would be possible to level off and strengthen the roof of a cell or cells and then attach the upper wall/roof component to the levelled roof so that the levelled roof member would become the floor of the upper cell.

Whereas the preferred form of the invention has been described in connection with houses the invention may be readily applied to a wide variety of different types of building such as motels, hotels, service areas of office buildings, industrial buildings, sheds, mobile houses, hospitals. This list is not comprehensive but merely given to indicate the wide variety of uses to which cells constructed according to the invention may be put.

We claim:

1. A transportable structurally stable cementitious building cell for the construction of a building, said cell being structured to form at least part of a room of said building, said cell comprising at least three substantially planar, substantially vertical walls having an average thickness of about ¼ inch to 2 inches except in minor areas of localized thickening, a substantially rectangular in plan, double continuous curved thin shell dome roof having substantially the structural action of a double curved thin shell dome, said dome being free of a major ridgeline, and extending upwardly in a curve from the tops of each of said walls, said roof having a rise to chord ratio not greater than 1:10 and not less than 1:60, the thickness of said roof being from about ¼ inch to 2 inches except in minor areas of localized thickening, a continuous edge stiffening member joining said roof to the top of said walls and serving to stiffen the edges of the roof to form, together with said walls and said roof, a structurally stable building cell, and a floor joined to the bottom of said walls, wherein the top of the roof of said cell, when the cell is in an unsupported, free standing condition and at least seven days after casting same, when loaded for about 2 hours with an evenly distributed load of about 30 pounds per square foot, will exhibit substantially full recovery after load removal.

2. Cell according to claim 1, wherein said cell has four walls, with adjoining walls being at substantially right angles to one another, and the cell is of concrete.

3. Cell according to claim 2, wherein the walls and the ceiling of said cell are about ⅜ inch to about 1½ inch thick.

4. Cell according to claim 2, wherein the said rise to chord ratio is about 1:15 to about 1:45.

5. Cell as claimed in claim 2, wherein said concrete contains at least one reinforcing material.

6. Cell of claim 5, wherein said concrete is formed from a mixture of Portland cement, sand, water and conventional additives, and the reinforcement is steel.

7. Cell according to claim 2, wherein said edge stiffening member has the internal appearance of a cornice cast integrally with the structure.

8. Cell according to claim 2, wherein the walls and the roof of the cell are cast monolithically.

9. Cell according to claim 8, wherein said concrete is reinforced with a steel welded mesh fabric.

10. Cell according to claim 2, wherein at least one wall has at least one external reinforcing rib.

11. Cell according to claim 2, wherein the floor of the cell is a reinforced concrete slab.

12. A transportable structurally stable building cell for the construction of a building, said cell being structured to form at least part of a room of said building, said cell comprising four substantially planar, substantially vertical reinforced concrete walls at substantially right angles to one another and having an average thickness of about ⅜ inch to 1½ inch except in minor areas of localized thickening, a substantially rectangular in plan, double continuous curved thin shell dome reinforced concrete roof having substantially the structural action of a double curved thin shell dome, said dome being free of a major ridgeline, and extending upwardly in a curve from the tops of each of said walls, said roof having a rise to chord ratio not greater than 1:10 and not less than 1:60, the thickness of said roof being from about ¼ inch to 2 inches except in minor areas of localized thickening, a continuous edge stiffening member joining said roof to the top of said walls and serving to stiffen the edges of the roof to form, together with said walls and said roof, a structurally stable building cell, and a floor joined to the bottom of said walls, wherein the top of the roof of said cell, when the cell is in an unsupported, free standing condition and at least seven days after casting same, when loaded for about 2 hours with an evenly distributed load of about 30 pounds per square foot, will exhibit substantially full recovery after load removal.

13. Cell according to claim 12, wherein said walls and said roof are cast monolithically to form an integral concrete structure.

14. Cell according to claim 13, wherein the said rise to chord ratio is about 1:15 to about 1:45.

15. Cell according to claim 14, wherein the floor of the cell is a reinforced concrete slab joined to the cell walls.

* * * * *